US009370218B2

(12) United States Patent
Tsai

(10) Patent No.: US 9,370,218 B2
(45) Date of Patent: Jun. 21, 2016

(54) DECORATIVE INTERCHANGEABLE BOUND EDGE FOR HATS

(71) Applicant: Kingto Tsai, Houston, TX (US)

(72) Inventor: Kingto Tsai, Houston, TX (US)

( * ) Notice: Subject to any disclaimer, the term of this patent is extended or adjusted under 35 U.S.C. 154(b) by 167 days.

(21) Appl. No.: 13/897,149

(22) Filed: May 17, 2013

(65) Prior Publication Data

US 2014/0338103 A1 Nov. 20, 2014

(51) Int. Cl.
*A42C 5/00* (2006.01)

(52) U.S. Cl.
CPC ..... *A42C 5/00* (2013.01)

(58) Field of Classification Search
CPC ..... A42B 1/02; A42B 1/063; A42C 1/06; A42C 5/00
USPC ..... 2/175.2, 175.3, 175.4, 175.5, 195.5, 2/195.6
See application file for complete search history.

(56) References Cited

U.S. PATENT DOCUMENTS

| | | | | |
|---|---|---|---|---|
| 1,412,479 | A * | 4/1922 | Mayleas | 2/175.1 |
| 2,617,110 | A * | 11/1952 | Rosenblatt | 2/181 |
| 6,151,712 | A * | 11/2000 | Lampi | A42B 1/02 2/10 |
| 6,561,393 | B1 * | 5/2003 | Cheng | 2/171.03 |
| 8,464,362 | B2 * | 6/2013 | Hersick | 2/5 |
| 2003/0041367 | A1 * | 3/2003 | Hadden et al. | 2/195.5 |
| 2003/0074716 | A1 * | 4/2003 | Park | 2/175.1 |
| 2004/0000004 | A1 * | 1/2004 | Wang | A42B 1/063 2/195.1 |
| 2005/0172380 | A1 * | 8/2005 | Turkington | 2/175.4 |
| 2006/0031975 | A1 * | 2/2006 | Hersick | 2/5 |
| 2007/0283482 | A1 * | 12/2007 | Lawrence | 2/209.12 |

* cited by examiner

*Primary Examiner* — Shaun R Hurley
*Assistant Examiner* — Andrew W Sutton
(74) *Attorney, Agent, or Firm* — John Alumit

(57) ABSTRACT

A device to bind the edge of a hat brim that is easily applied to a hat and can be reformed and removed as desired. A malleable forming member, enveloped by a covering material, allows the device to be folded over the edge of a hat brim and the brim formed to the desired curvature. The covering material that envelops the forming member provides a finished appearance to the device and may be comprised of textiles in any color or texture, so it may be interchanged with other devices to suit the appearance of the hat or its wearer.

9 Claims, 3 Drawing Sheets

DECORATIVE INTERCHANGEABLE BOUND EDGE FOR HATS

CROSS-REFERENCE TO RELATED APPLICATION

Not Applicable

FEDERALLY SPONSORED RESEARCH

Not Applicable

SEQUENCE LISTING OR PROGRAM

Not Applicable

BACKGROUND

The invention relates to a decorative, interchangeable bound edge for hats.

Head coverings in the form of a hat often comprise: a crown, the portion of the hat that covers the top of the head; and a brim, the horizontal projection of stiff material from the bottom of the hat's crown around all or a portion of the circumference of the hat. The edge of a hat brim is often bound together and the brim shaped into a curved form by attaching a binding along the edge of the hat brim.

The use of glue or sewing to bind and form the hat brim results in a binding that is permanently attached to the hat brim. Because the binding is a stylized element of the hat, the ability to change the binding color, material, or brim shape is desirable. With an interchangeable bound edge for hat brims, the binding may be selected or exchanged to match or compliment the hat material and color, clothing material and color, and other aspects of a person's appearance (e.g., hair, skin, painted nails, etc.).

Information relevant to attempts to address this desire can be found in U.S. Pat. Nos. 111,178, 197,767, 280,982 and D419,281. U.S. Pat. No. 111,178 to Corey uses a strip of felt or cloth impregnated with shellac or other stiffening gum that allows the material to be susceptible to change in shape or position with heat or pressure. The impregnated strip is then secured to the outer edge of the hat brim by sewing or adhered with a glue or cement. However, Corey requires heat or pressure to permanently attach the device. U.S. Pat. No. 197,767 to Diamant comprises a hat brim stiffening piece made from a perforated sheet metal or tin piece that is stitched to edge of a hat brim. However, the stiffening piece in Diamant must be sewn to the hat brim. U.S. Pat. No. 280,982 to Wheeler comprises a wire hoop with binding sewn onto the hoop, the wire and binding is then applied in the curl of a hat brim with the binding drawn tightly over the curl and fastened to the hat. However, the wire and binding of Wheeler must be wedged or sewn into the curl of a hat. If the hat brim does not curl inwards toward the crown, the particular device cannot be used. U.S. Pat. No. D419,281 to Croft is a trim piece for the bill of a cap comprising a u-shaped channel attached by sliding the channel over the bill of the cap. However, the device of Croft cannot be used to customize the hat brim curvature.

For the foregoing reasons, there is a need for a bound edge for hat brims that is easily interchangeable and allows the curvature of the brim to be formed as desired. The solution is found in the present invention, which comprises a covering material with flaps that envelop a forming member. Because the forming member is malleable, the device can be reformed on the hat or removed and exchanged as desired. Not only would an interchangeable bound edge be desirable in changing the appearance of a hat, it can also be used for existing hats whose bounded edges have lost their adhesive ability or have been worn off.

SUMMARY

The present invention is directed to a device that satisfies the need for an interchangeable bound edge for hat brims that can be easily substituted by interchangeable bound edges of different materials, shapes, and colors, while at the same time allows the brim curvature to be formed as desired. The device comprises a covering material with flaps that envelope a forming member. The forming member is comprised of a malleable material and allows the device to be folded around a hat brim edge and formed to the desired curvature. Unlike other binding for hat brims that are attached to a hat using an adhesive or thread and then permanently formed using heat or curing of the adhesive, the present invention may be interchanged with other bound edges of different materials, shapes, and colors, and then re-formed on the hat indefinitely.

The covering material that envelops the forming member provides a finished appearance and protects the hat brim. The material may be made from cloth or other textiles and can comprise any color or texture, allowing for the customization of any hat brim.

DRAWINGS

DESCRIPTION

Figure 1:
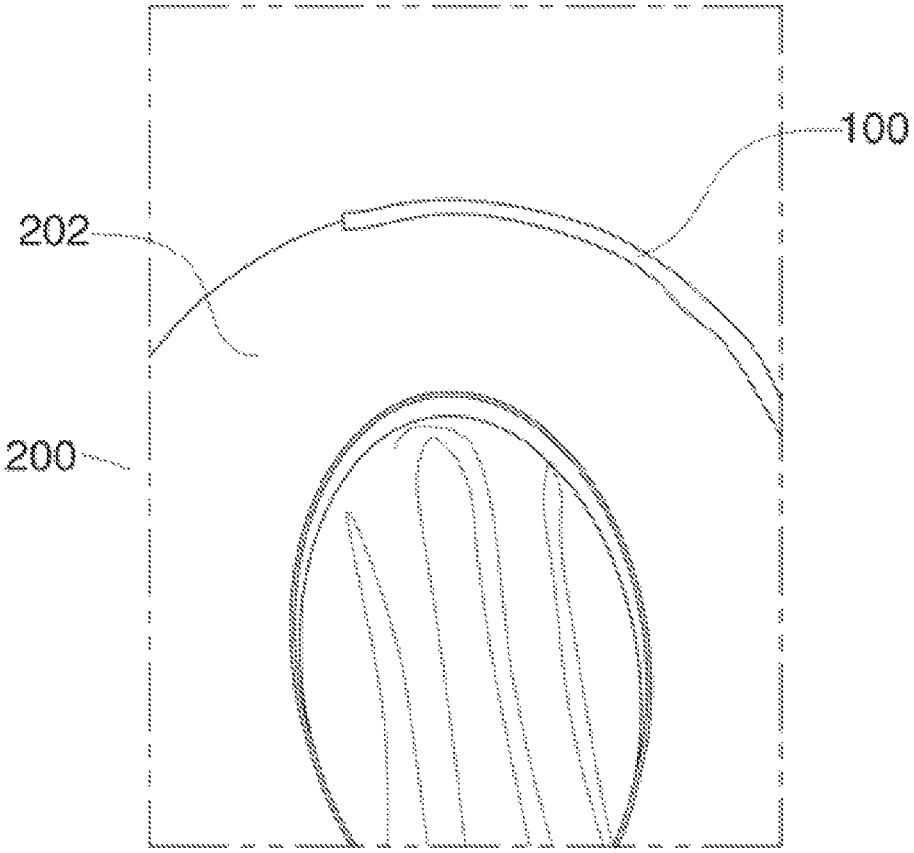
FIG. 1 illustrates a top view of a hat with bound edge applied to a portion of the brim embodying features of the present invention for an interchangeable bound edge for hats.
Figure 2:
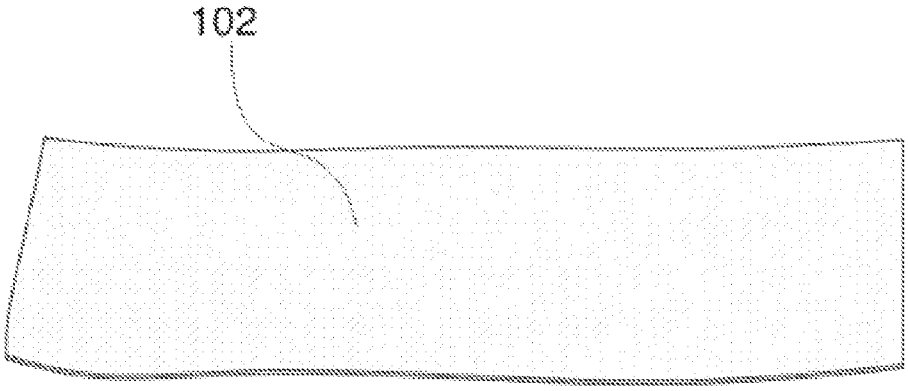
FIG. 2 illustrates a top perspective view of an elongated covering material.
Figure 3:
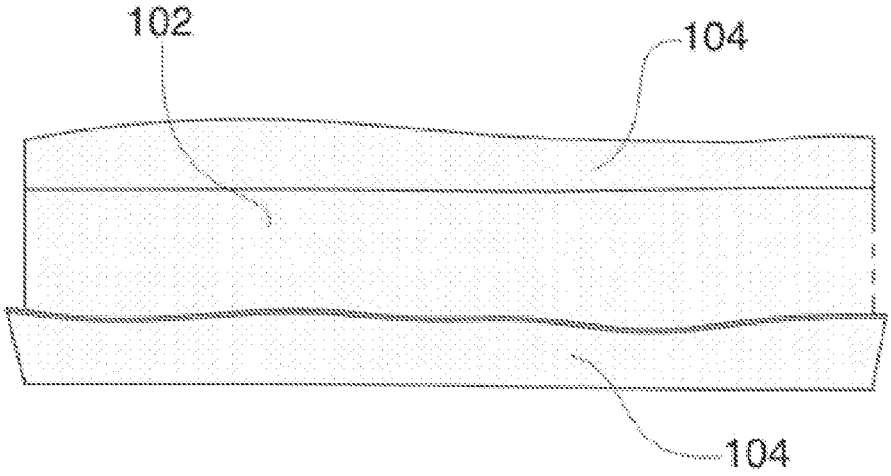
FIG. 3 illustrates a top perspective view of an elongated covering material with flaps along its length.

As shown in FIGS. 1-5, an interchangeable bound edge for hats 100 comprises a covering material 102, a forming member 106, and an attachment of the covering material 102 to the forming member 106 using methods such as adhesives or thread 108. The covering material, illustrated in FIG. 2 is an elongated flexible material and may be made from a synthetic or natural fabric. As illustrated in FIG. 3, several flaps 104 are made along the length of the covering material 102, creating an inside and outside surface. The flaps 104 are directed toward the inside surface of the covering material 102. Preferably, the length of the covering material 102 and forming member 106 are sufficient to extend along the circumferential length of the hat brim 202 edge. The width of the forming member 106 should be sufficient to provide the desired binding appearance once the interchangeable bound edge for hats 100 is applied to the hat brim 202 as best illustrated in FIG. 1.

Figure 4:
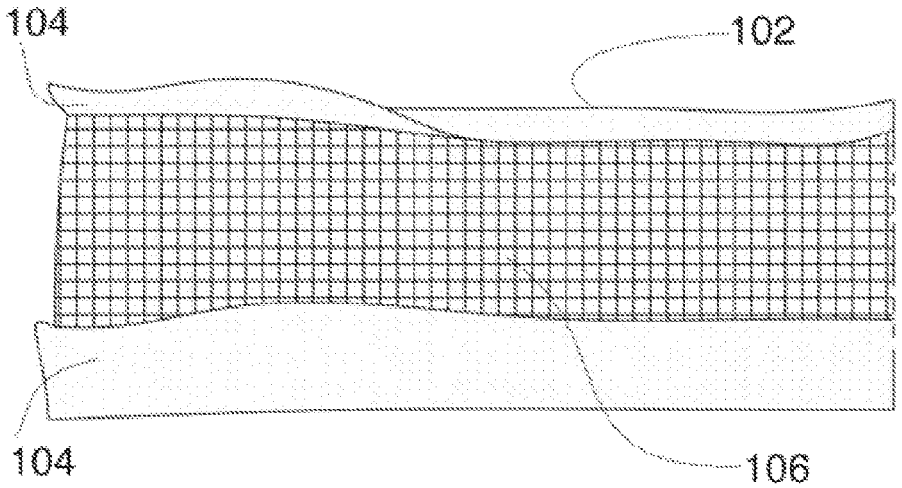
FIG. 4 illustrates a top perspective view of an elongated covering material with flaps folded over a mesh forming member.

Referring to FIG. 4, a forming member 106 is placed onto the inside surface of the covering material 102 so that the flaps 104 envelop the forming member 106. The forming member 106 is a malleable material and may be comprised of a wire mesh or a series of parallel wires. The covering material 102 is attached to the forming member 106 using an adhesive such as glue or a binding method such as sewing 108 threads along the flaps 104 as best illustrated in FIG. 5.

Figure 5:
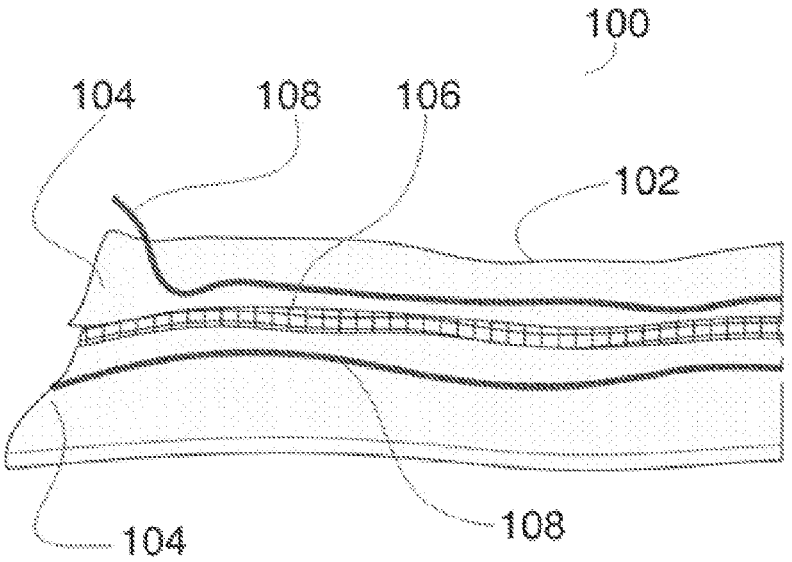
FIG. 5 illustrates a top perspective view of a covering material being adhered to a forming member with thread.

The interchangeable bound edge for hats 100 is used by folding the width of the device over the edge of a hat brim 202 so the flaps 104 are in contact with the hat 200 (FIGS. 4-5). Continue folding the interchangeable bound edge for hats 100 onto the edge of a hat brim 202 until the entire length of the device is utilized (FIG. 1). If the interchangeable bound edge for hats 100 is longer than the circumferential length of the hat brim 202, the excess length may be cut off. The interchangeable bound edge for hats 100 may be removed from the hat 200 by unfolding the device from the hat brim 202.

All features disclosed in this specification, including any accompanying claim, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed:

1. A device for removably binding the edges of a hat brim, the device comprising: an elongated covering material; and an elongated forming member that is malleable and flat to allow a user to form a desired curvature for the elongated covering material; the elongated covering material having a surface area larger than the elongated forming member and disposed around the elongated forming member so that a first side of the elongated forming member is completely covered and a second side of the elongated forming member is only partially covered at a top and bottom portion of the second side while a central portion of the second side is exposed, wherein the width of the device is sufficient to fold over only the edges of a hat brim, and wherein the malleability of the elongated forming member allows the device to adhere to a hat edge brim without the need for sewing or adhesives.

2. The device for binding the edge of a hat brim of claim 1, wherein the device is of sufficient length to cover the circumferential length of the edges of the hat brim.

3. The device for binding the edge of a hat brim of claim 1, wherein the covering material is comprised of a flexible textile.

4. The device for binding the edge of a hat brim of claim 1, wherein the covering material comprises flaps along its length that fold over the forming member.

5. The device for binding the edge of a hat brim of claim 1, wherein the forming member comprises a wire mesh.

6. The device for binding the edge of a hat brim of claim 1, wherein the forming member comprises a series of parallel wires.

7. The device for binding the edge of a hat brim of claim 1, wherein the covering material and forming member are adhered to each other with an adhesive.

8. The device for binding the edge of a hat brim of claim 1, wherein a thread binds the covering material and forming member to each other.

9. A method for removably binding the edge of a hat brim, comprising the steps of: attaching an elongated forming member that is malleable and flat onto the inside surface of an elongated covering material so the elongated covering material completely envelops the elongated forming member on a first side and only partially envelopes the elongated forming member on a second side at a top and bottom portion of the second side while a central portion of the second side is exposed, then folding the combined elongated forming member and elongated covering material over the edge of the hat brim on the side of the combined elongated forming member and elongated cover material that is the same side as the second side of the elongated forming member, so that portions of the elongated covering material are pinned against the hat brim by the elongated forming member.

* * * * *